US005672003A

United States Patent [19]

Shemitz et al.

[11] Patent Number: 5,672,003

[45] Date of Patent: Sep. 30, 1997

[54] UNIVERSAL TRACK LIGHT MOUNTING SYSTEM

[75] Inventors: Sylvan R. Shemitz; David B. Miller, both of Woodbridge, Conn.

[73] Assignee: Sylvan R. Shemitz Designs, Inc., West Haven, Conn.

[21] Appl. No.: 600,274

[22] Filed: Feb. 9, 1996

[51] Int. Cl.[6] ..... F21V 21/00

[52] U.S. Cl. ..... 362/396; 362/418; 362/404; 248/214

[58] Field of Search ..... 362/396, 147, 362/404, 418; 439/110, 116–122; 248/214; 403/363, DIG. 9, 260, 11, 12

[56] References Cited

U.S. PATENT DOCUMENTS

| | | | |
|---|---|---|---|
| 1,304,787 | 5/1919 | Macneale | 362/396 |
| 1,482,454 | 2/1924 | Batcheller | 362/396 |
| 1,808,628 | 6/1931 | Bond | 248/214 |
| 2,140,224 | 12/1938 | Galgoczy | 280/11.37 |
| 2,502,566 | 4/1950 | Hooley | 240/6.4 |
| 3,066,273 | 11/1962 | Herrmann et al. | 439/118 |
| 3,936,023 | 2/1976 | Clifton | 248/228 |
| 4,190,881 | 2/1980 | Drost et al. | 362/250 |
| 4,414,617 | 11/1983 | Galindo | 362/404 |
| 4,449,168 | 5/1984 | Ewing | 362/404 |
| 4,837,665 | 6/1989 | Hoyer et al. | 362/96 |
| 4,885,667 | 12/1989 | Selden | 362/253 |
| 5,203,626 | 4/1993 | Clement | 362/250 |
| 5,341,276 | 8/1994 | Shen | 362/226 |

*Primary Examiner*—Ira S. Lazarus
*Assistant Examiner*—Sara Sachie Raab
*Attorney, Agent, or Firm*—Fish & Neave; Jeffrey H. Ingerman; Garry J. Tuma

[57] ABSTRACT

A universal track light mounting system for mounting luminaires or other components to track lighting tracks of different sizes. The system includes a universal track clamp having first and second brackets that mount around the outside of a track. One bracket engages the top and one side of the track while the other engages the top and one other side of the track. A clamp fastener adjustably interconnects the brackets. A third bracket may be provided to anchor the clamp fastener to one of the first and second brackets. The adjustable interconnection enables the universal track clamp to mount to tracks of different sizes. To accommodate luminaires of different sizes, the clamp has several attachment positions, which also provide a coarse adjustment of the width of the clamp. Because luminaires are mounted to the track by a clamp around the outside of the track, a separate power adapter is provided to connect the luminaire to power conductors inside the track.

19 Claims, 4 Drawing Sheets

FIG. 8
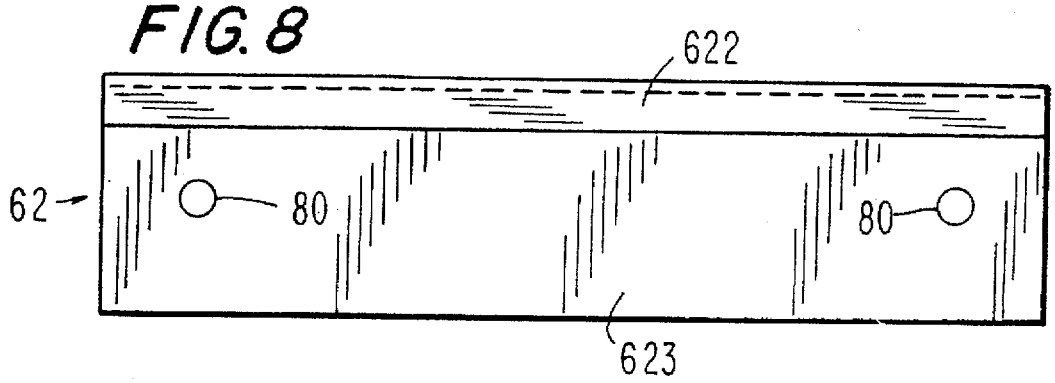
FIG. 9A
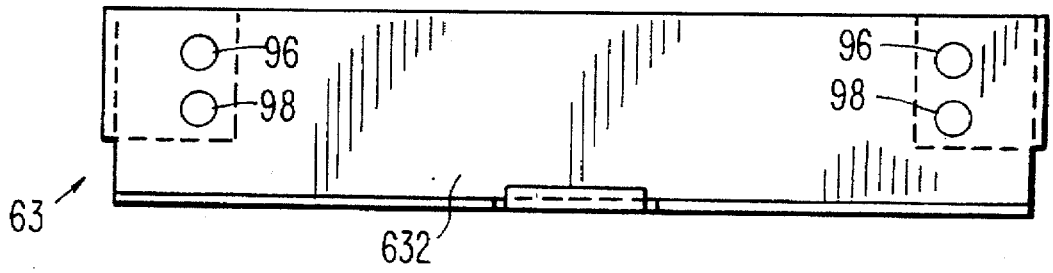
FIG. 9B
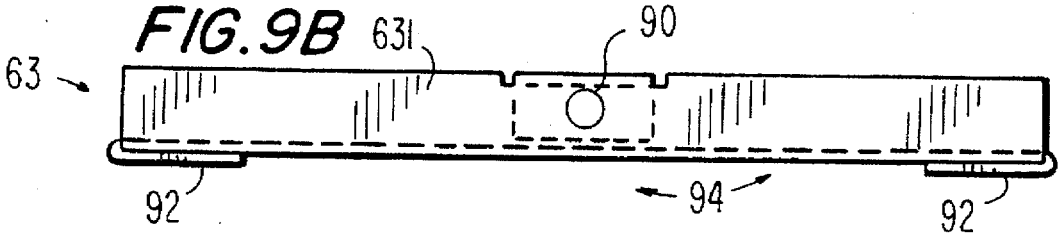
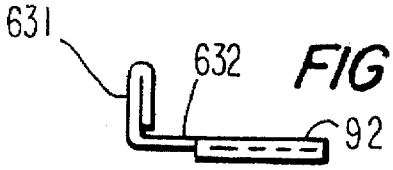
FIG. 9C
FIG. 10
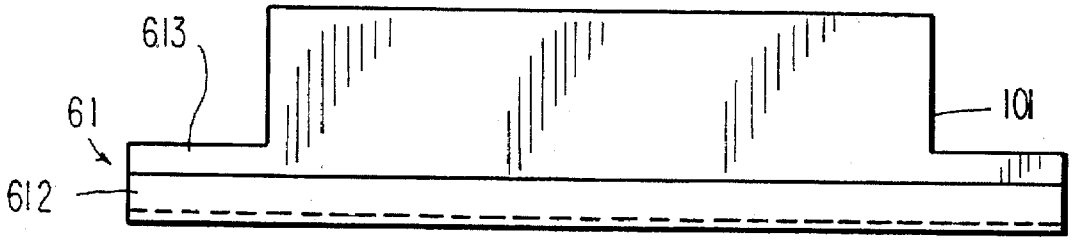

UNIVERSAL TRACK LIGHT MOUNTING SYSTEM

BACKGROUND OF THE INVENTION

This invention relates to a universal track light mounting system for mounting track lighting components—e.g., luminaires (lighting fixtures with lamps), commonly referred to as track lighting "heads"—to a track lighting track.

Track lighting tracks come in a variety of sizes and configurations, but most commonly are elongated, with a generally rectangular cross section. One side—typically one of the longer sides of the rectangle—is attached to the mounting surface, which may be a ceiling or sometimes a wall. The opposite side usually has an opening that extends longitudinally along the track, surrounded by flanges that partially close off that side near both edges of that side. The opening allows access to the interior, which contains power conductors usually running along the other two sides. The heads and other track lighting components and accessories are commonly attached to the track by a mechanism that extends into the open side with "fingers" that both connect to the power conductors and retain the components on the track. Commonly, these fingers are mounted on a turret that is rotatable between a first position in which the fingers are parallel to the longitudinal direction of the track, and a second position in which the fingers are perpendicular to the first position. Such a component would be positioned on the track with the turret in the first position such that the fingers can be inserted in the opening in the track, and then the turret would be rotated to the second position to lock the component in place by engagement with the flanges and to connect the fingers to the power conductors.

A typical track light mounting mechanism is usually designed for only a specific track. Thus, the track lighting components of one manufacturer may not be compatible with the track lighting tracks of other manufacturers. Accordingly, those interested in installing or modifying a track lighting system generally are limited to those components that are designed for the same system. Further, the dual purpose mounting mechanism just described usually is not very sturdy and could not be used, for example, to support heavier components.

Clamps which attach around the outside of track lighting tracks, and from which components can be supported, are known. However, the known clamps still cannot mount to tracks of many different sizes. For example, in one known system, components are clamped to the outside of a tubular track by adjustable clamps having arms that are bent to accommodate the curved surface of the tube. However, the clamps would not accommodate tubes with more than a small range of different radii and curvatures.

In addition, in a clamp-type track lighting system, a different mechanism must be found to connect the components to the power conductors. In the known clamp-type system just described, for example, power outlets are provided at fixed locations along the track, and a power cord from each component is plugged into the nearest outlet. This Limits the number and location of components in that system.

Therefore, it would be desirable to be able to provide a track lighting clamp that can mount different types of components of varying weights to track lighting tracks of different sizes, and a track lighting system using such a clamp.

It would also be desirable to be able to provide such a track lighting system in which the number and location of power connections is not limited.

SUMMARY OF THE INVENTION

It is an object of this invention to provide a universal track lighting clamp that can mount different types of components of varying weights to track lighting tracks of different sizes.

It is also an object of this invention to provide a track lighting system that uses such a universal track lighting clamp.

It is a further object of this invention to provide a track lighting system in which the number and location of power connections is not limited.

In accordance with this invention, there is provided a universal track light clamp for mounting track lighting components to the outside of a track lighting track. The clamp has two brackets, one that engages the top and one side of the track while the other engages the top and the other side of the track—the "top" being defined as the side of the track that is fastened to the mounting surface, which may be a ceiling or wall. The brackets are adjustably interconnected for varying separation therebetween for accommodating tracks of different sizes. The clamp cooperates with component fasteners for connecting track lighting components to the clamp. A track lighting system using the universal track clamp in which the number and location of the power connections is not limited is also provided.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which:

FIG. 8 is a plan view of the second bracket of the universal track lighting clamp of FIGS. 1–4, 6 and 7;

FIGS. 9A, 9B and 9C are plan, front and side views, respectively, of the third bracket of the universal track lighting clamp of FIGS. 1–4 and 6–8; and FIG. 10 is a plan view of the first bracket of the universal track lighting clamp of FIGS. 1–4 and 6–9C.

DETAILED DESCRIPTION OF THE INVENTION

Figure 1:
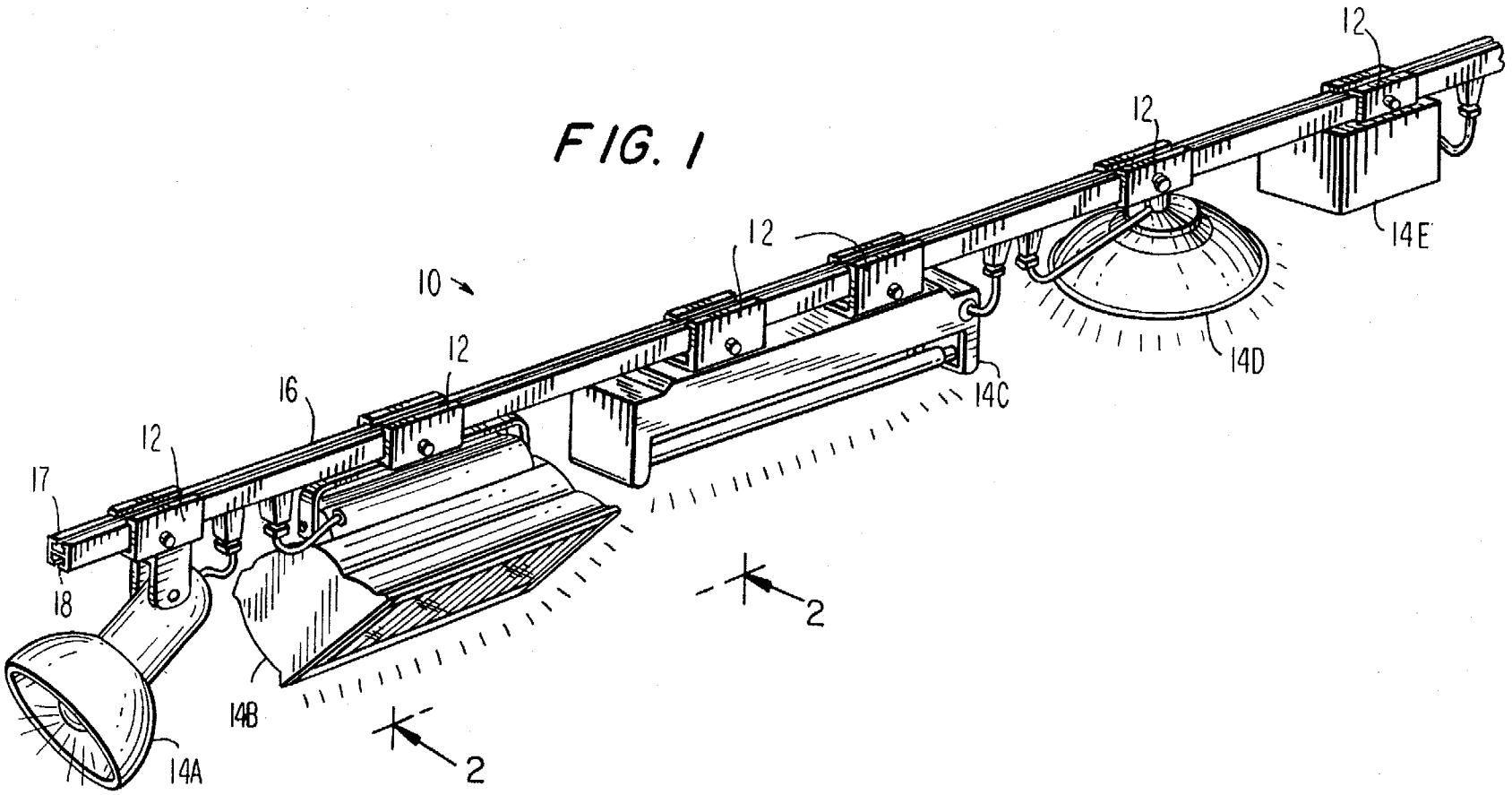
FIG. 1 is a perspective view of a preferred embodiment of a universal track light mounting system illustrating several track lighting components of different types and weights according to the present invention.

The present invention provides a clamp that adjustably mounts to tracks of different sizes and can support different types of components of varying weights. This is achieved with two brackets that are adjustably interconnected for variable separation therebetween to accommodate tracks of different sizes. The separation between the brackets is varied with separate coarse and fine adjustments. The clamp mounts to the track with one bracket engaging the top and one side of the track while the other bracket engages the top and the other side of the track. Each bracket has an upper flange that is adjacent and substantially parallel to the top of the track. The weight of the component is distributed across the surface area of the clamp in contact with the track, rather than being concentrated on the small contact fingers of the known systems. This enables the clamp generally to support loads heavier than previously known systems.

A preferred embodiment of a track light mounting system 10 is shown in FIGS. 1–10. System 10 includes several lighting components 14A, 14B, 14C, 14D and 14E of various types (e.g., component 14E is a ballast), sizes, and weights. Each component is mounted to a track lighting track 16 with one or more universal track lighting clamps 12 (e.g., component 14C is long enough to require two clamps 12). Track lighting track 16 has a generally rectangular cross section with a "top" side 17 attached to a mounting surface 32. The mounting surface may be a ceiling, wall, or other apprpriate surface. Track 16 has a partially open "bottom" side 18 opposite top side 17 for providing access to power conductors 30 running longitudinally inside track 16 in a manner similar to that used to mount lighting heads in the previously known systems described above.

Figure 2:
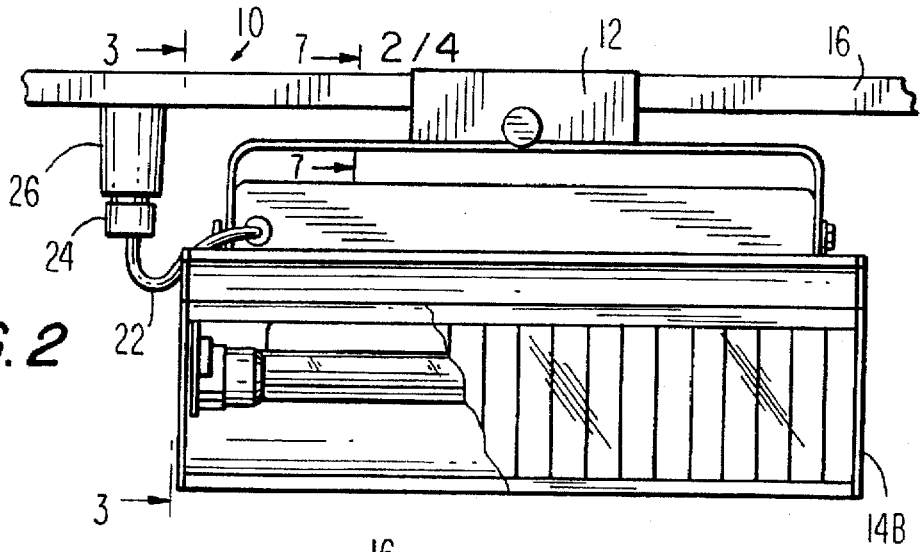
FIG. 2 is an elevational view of a portion of the universal track light mounting system of FIG. 1 taken from line 2—2 of FIG. 1.
Figure 3:
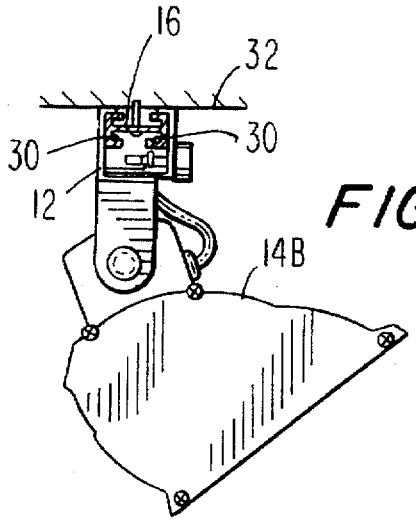
FIG. 3 is a cross-sectional view, partly in elevation, of the universal track light mounting system of FIGS. 1 and 2 taken from line 3—3 of FIG. 2.

As best seen in FIGS. 2 and 3, clamp 12 is mounted around the outside of track 16, and is attached to a component 14B having a power cord 22 and a connector 24. Connector 24 is at an end of power cord 22 distal from component 14B and mates with one end of power adaptor 26. The other end of adaptor 26 conductively connects with power conductors 30 running longitudinally inside track 16. According to the invention, only adaptors 26 need be specific to the type of system being used. Preferably, only one set of heads and clamps according to the invention can be kept in stock by a supplier or retailer, who need maintain a varied inventory only of adapters 26 for different systems.

Figure 4:
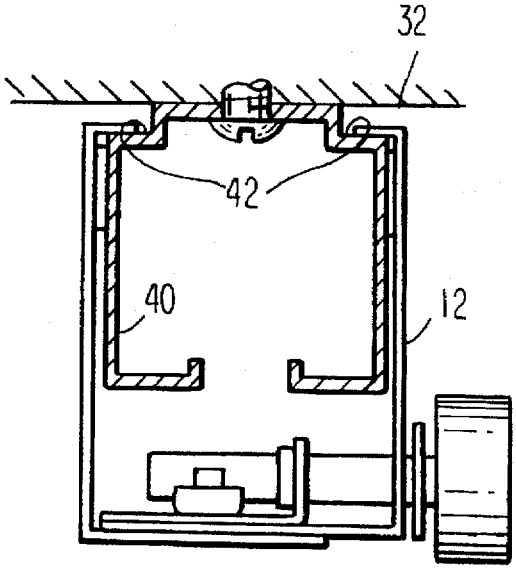
FIG. 4 is a cross-sectional view of the track lighting clamp of FIGS. 1–3, used with a track lighting track having a different configuration.
Figure 5:
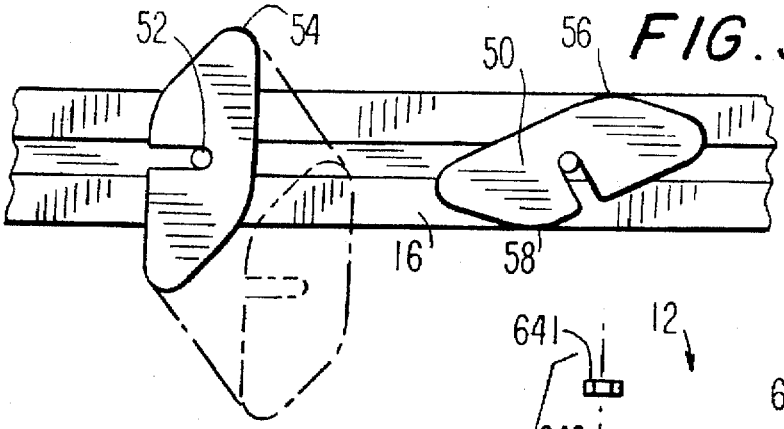
FIG. 5 is a plan view of two spacers and a track lighting track.
Figure 7:
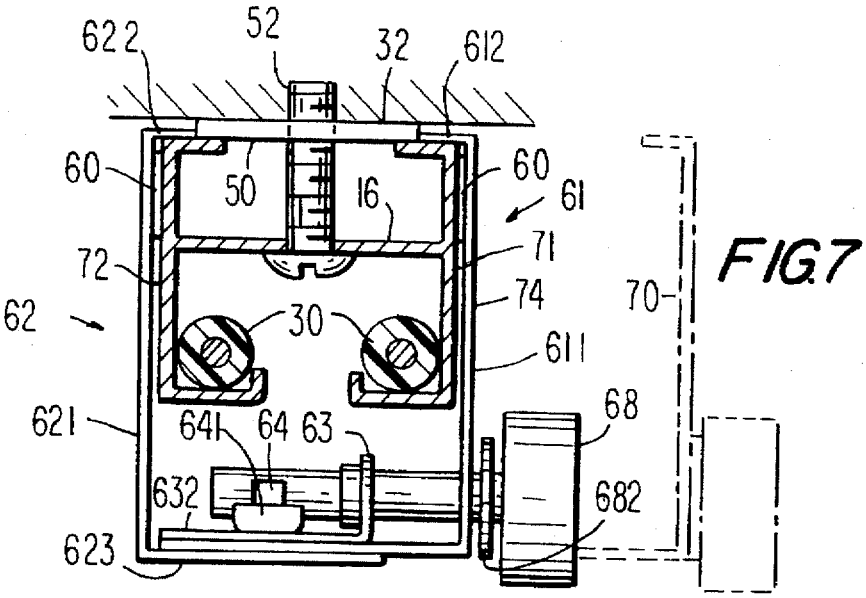
FIG. 7 is a cross-sectional view of a portion of the universal track light mounting system of FIGS. 1–6, taken from line 7—7 of FIG. 2.

Some tracks 40 are configured with "ledges" 42 on the top surface of the track as shown in FIG. 4. These ledges 42 form recesses between track 40 and mounting surface 32 that permit clamp 12 to engage track 40. However, if the track is generally rectangular as shown in FIGS. 1, 3, and 7, the space between the top of track 16 and surface 32 may be insufficient to permit clamp 12 to engage the top of track 16. For these rectangular type tracks, a spacer 50 is provided. As shown in FIG. 5, track 16 is mounted to a surface 32 with mounting hardware 52. Mounting hardware 52 can be toggle bolts, screws (with or without anchors), or other appropriate connectors. Spacer 50 engages mounting hardware 52 for rotation in a plane parallel to the top of track 16. Spacer 50 has curved edges 54 of varying radii and curvatures. When rotated, portions of edges 54 can be made simultaneously and substantially flush with sides 56 and 58 of track 16. The varying radii and curvatures allow spacer 50 to be used with tracks of different widths and still be made substantially flush with sides 56 and 58. In this position, spacer 50 is substantially inconspicuous.

It should be noted, of course, that the present invention also is useful with tracks that are not mounted on any surface, but rather are suspended from a surface or from other structural elements. For example, the "track" may be a longitudinal structural element such as that sold under the trademark UNISTRUT® by Unistrut International Corporation, of Ann Arbor, Mich.

Figure 6:
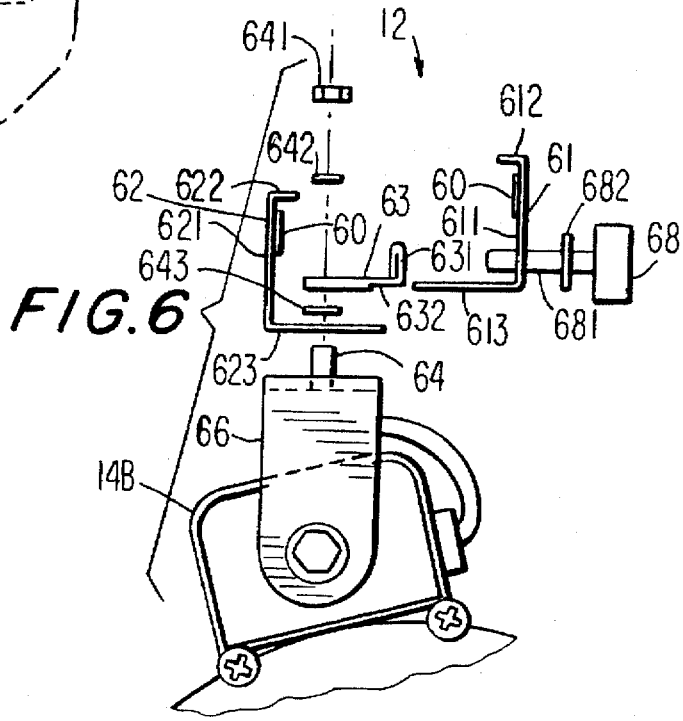
FIG. 6 is an exploded side view of a preferred embodiment of the universal track lighting clamp of FIGS. 1–4.

FIG. 6 is an exploded side view of preferred embodiment of clamp 12 which preferably includes a first bracket 61 and a second bracket 62. First bracket 61 preferably is a rigid, generally U-shaped bracket preferably having a first main web 611, a first upper flange 612, and a first lower flange 613. Second bracket 62 preferably is also a rigid, generally U-shaped bracket preferably having a second main web 621, a second upper flange 622, and a second lower flange 623.

As shown in FIG. 7, second bracket 62 engages one side of track 16 and first bracket 61 engages the other side of track 16. In particular, second upper flange 622 is adjacent and substantially parallel to the top of track 16, while second main web 621 is adjacent and substantially parallel to one side of track 16. First upper flange 612 is adjacent and substantially parallel to the top of track 16, while first main web 611 is adjacent and substantially parallel to the other side of track 16. First bracket 61 and second bracket 62 are adjustably interconnected for varying separation therebetween for accommodating tracks of different sizes.

Clamp 12 is preferably relatively long to provide increased surface area of first upper flange 612 and second upper flange 622 in contact with track 16 to support and transfer the weight of component 14B or other fixture or accessory (not shown) to track 16. The increased surface area lessens the weight per unit area exerted on clamp 12, which enables clamp 12 to support heavier components than clamps that have less surface area in contact with track 16. Generally, this may shift the maximum component weight limit from clamp 12 to the limits of the intrinsic strength of track 16 itself or the mounting hardware 52 used to attach track 16 to surface 32.

Two or more clamps could be used for longer components. In addition to luminaires or other lighting heads, other components that could be mounted with clamp 12 include ballasts or transformers for lighting components, as well as non-lighting components such as banners, signs, advertisements, baskets, storage bins, etc.

The inside surfaces of first bracket 61 and second bracket 62 are preferably treated with a protective material 60 to prevent marring of the finish of track 16. Protective material 60 is preferably felt, but could also be foam rubber or any other suitably protective material.

The adjustable interconnection between first bracket 61 and second bracket 62 may be accomplished with a clamp fastener 68 inserted through a hole in first main web 611 and anchored in a threaded hole (not shown) in second main web 621. The threads of clamp fastener 68 allow fine adjustments of clamp 12 for tightening and releasing clamp 12 to and from tracks 16 of different widths. Clamp fastener 68 is preferably a one-piece thumbscrew with a threaded shaft 681, but could also be a standard or Phillips-head screw, or other appropriate fastener.

A third bracket 63 is preferably provided as part of the adjustable interconnection of first bracket 61, second bracket 62, and a lighting component, with threaded hole 90 for accepting clamp fastener 68 being in third bracket 63 rather than in second bracket 62. In addition, in cooperation with second bracket 62, third bracket 63 provides several attachment positions for accommodating different types of components, so that a desired "front" surface of a component preferably can be made flush with second main web 621 of clamp 12 regardless of the size of the component. These attachment positions also permit coarse adjustments to the width of clamp 12—that is, discrete sets of minimum and maximum distances between first bracket 61 and second bracket 62.

Third bracket 63 preferably is a rigid, generally L-shaped bracket having a support member 631 and a base member 632. As illustrated in FIGS. 6—9B, support member 631 contains a threaded hole 90 for receiving threaded shaft 681 of clamp fastener 68, which is inserted through washer 682 and first main web 611. With third bracket 63 incorporated into clamp 12 in this manner, shaft 681 of clamp fastener 68 preferably no longer protrudes from second main web 621 of second bracket 62 and is therefore concealed from view.

One or more component fasteners 64 attach a component to clamp 12. In the embodiment shown, component fastener 64 is a machine screw set in the yoke 66 of component 14B, and is secured to clamp 12 with a nut 641 and washers 642 and 643.

To install a component to track 16, clamp 12 is first attached to the component. Clamp fastener 68 is then adjusted to open position 70 as shown in FIG. 7, and the combined component (e.g., 14B) and clamp 12 are positioned so that first bracket 61 and second bracket 62 surround track 16. Clamp fastener 68 is then tightened to secured position 74 by bringing first bracket 61 and second bracket 62 together until brackets 61 and 62 engage surfaces 71 and 72 of track 16. Preferably, second upper flange 622 of second bracket 62 may be rested on track 16 to support the weight of the component while clamp fastener 68 is being tightened.

As shown in FIGS. 6 and 7, base member 632 is adjacent and substantially parallel to second lower flange 623. Preferably, base member 632 has two thickened portions 92 that create an opening 94 between base member 632 and second lower flange 623. Opening 94 preferably is in alignment with an extending portion 101 of first lower flange 613 for receiving extending portion 101 when clamp 12 is secured to track 16.

Base member 632 preferably also contains two pairs 96 and 98 of base holes spaced a first distance apart in the longitudinal direction. Second lower flange 623 of second bracket 62 contains a pair of second flange holes 80 also spaced the same first distance apart in the longitudinal direction. Depending on the type of component or the location of component fasteners 64, third bracket 63 is adjusted with respect to second bracket 62 to align either base hole pair 96 or base hole pair 98 with second flange hole pair 80. Once aligned, component fasteners 64 are inserted and secured to clamp 12. The choice of holes preferably is made to align a certain surface of a component with second main web 621 of clamp 12.

Having more than one hole pair 96 or 98 also allows coarse adjustments to the width of clamp 12, as described above. By aligning base hole pair 98 with second flange hole pair 80, a first minimum distance and a first maximum distance between first bracket 61 and second bracket 62 are created. Alternatively, by aligning base hole pair 96 with second flange hole pair 80, a larger minimum distance and a larger maximum distance between first bracket 61 and second bracket 62 are created. Additional hole pairs can also be provided increasing the range of adjustments.

As shown, clamp 12 is capable of mounting to a range of track sizes. In other embodiments, a modification to the dimensions of the clamp components in accordance with the principles of the present invention permits the clamp to accommodate other ranges of track and component sizes. In addition, modification to the number, size, and placement of holes in base member 632 and second lower flange 623, also in accordance with the principles of the present invention, also permits adjustment to different track and component sizes. Furthermore, use of the universal track clamp permits variable positioning of lighting components and power adaptors along a track lighting track, resulting in substantially the same number of components as provided for in previously known systems.

Thus it is seen that a universal track light mounting system for mounting various types of luminaires to tracks of different sizes is provided. One skilled in the art will appreciate that the present invention can be practiced by other than the described embodiments, which are presented for purposes of illustration and not of limitation, and the present invention is limited only by the claims which follow.

What is claimed is:

1. A universal track clamp for mounting a track lighting component to the outside of a lighting track, said track having a length and having a top, a bottom, a first side, and a second side defining a cross section perpendicular to said length, said cross section being substantially rectangular, said clamp comprising:

a first bracket; and a second bracket; wherein:

said first bracket engages said top and one of said sides of said track;

said second bracket engages said top and one other of said sides of said track; and said first bracket and said second bracket are adjustably interconnected for varying separation therebetween for accommodating tracks of different sizes; wherein:

said clamp cooperates with a component fastener for connecting said clamp to said lighting component.

2. The universal track clamp of claim 1 further comprising a clamp fastener for providing said adjustable interconnection between said first bracket and said second bracket.

3. The universal track clamp of claim 1 wherein:

said first bracket has an inside surface;

said second bracket has an inside surface; and said clamp further comprises a surface treatment applied to said inside surface of said first bracket and said inside surface of said second bracket to prevent marring of said track.

4. The universal track clamp of claim 3 wherein said surface treatment comprises at least one felt pad.

5. The universal track clamp of claim 1 further comprising a third bracket, said third bracket being interconnected with said first bracket, said second bracket, and said lighting component.

6. The universal track clamp of claim 5 further comprising a clamp fastener for providing an adjustable interconnection between said first bracket and said third bracket.

7. The universal track clamp of claim 6 wherein said clamp fastener comprises an elongated threaded shaft, and said third bracket has a threaded hole therein for threadably receiving said shaft.

8. The universal track clamp of claim 5 wherein:

said first bracket has a first main web, a first upper flange extending substantially perpendicularly from said first main web, and a first lower flange extending substantially perpendicularly from said first main web, said first lower flange having an outward extending portion;

said second bracket has a second main web, a second upper flange extending substantially perpendicularly from said second main web, and a second lower flange extending substantially perpendicularly from said second main web; and said third bracket has a support member and a base member substantially perpendicular to said support member, said base member having at least one thickened portion; wherein:

said base member and said second lower flange are adjacent and substantially parallel; and said at least one thickened portion and said second lower flange create an opening in alignment with said extending portion for receiving said extending portion therein.

9. The universal track clamp of claim 8 wherein:

said component fastener has a shaft;

said base member has at least one pair of base holes therein, said base holes in each said at least one pair of base holes being spaced apart by a first distance along said length; and said second lower flange has a pair of second flange holes therein, said second flange holes being spaced apart by said first distance along said length; wherein:

said pair of second flange holes is in alignment with one of said at least one pair of base holes, said aligned holes receiving said shaft of said component fastener for fastening said lighting component to said clamp and for providing coarse adjustment of said adjustable interconnection of said first bracket and said second bracket.

10. The universal track clamp of claim 8 further comprising a clamp fastener adjustably interconnecting said first main web and said support member.

11. The universal track clamp of claim 10 wherein said clamp fastener comprises an elongated threaded shaft, and said support member has a threaded hole therein for threadably receiving said shaft.

12. The universal track clamp of claim 5 wherein:

said component fastener has a shaft;

said third bracket has a base member and a support member, said base member having at least one pair of base holes therein, said base holes in each said at least one pair of base holes being spaced apart by a first distance along said length; and said second bracket has a main web, an upper flange, and a lower flange, said lower flange having a pair of flange holes therein, said flange holes being spaced apart by said first distance along said length; wherein:

said pair of flange holes is in alignment with one of said at least one pair of base holes, said aligned holes receiving said shaft of said component fastener for fastening said lighting component to said clamp and for providing coarse adjustment of said adjustable interconnection of said first bracket and said second bracket.

13. A track lighting system, comprising:

a track lighting track, said track being elongated in a longitudinal direction and having a top, a bottom, a first side, a second side, and a hollow interior for receiving power conductors, said power conductors being disposed along and between said first side and said second side and extending along said longitudinal direction, said track having an opening in said bottom for insertion of connectors for connecting conductively to said power conductors;

at least one track lighting component having at least one component fastener and a power cord, said power cord having a connector at an end distal from said at least one lighting component;

at least one universal track clamp, comprising:

a first bracket, and a second bracket, wherein:

said first bracket engages said top and one of said sides of said track, said second bracket engages said top and one other of said sides of said track, and said first bracket and said second bracket are adjustably interconnected for varying separation therebetween for accommodating tracks of different sizes; wherein:

said clamp cooperates with at least one of said at least one component fastener for connecting said clamp to said at least one lighting component; said track lighting system further comprising:

at least one power adapter having a first end for engaging said power conductor through said opening in said bottom and a second end for mating with said connector of said at least one lighting component.

14. The track lighting system of claim 13 further comprising at least one spacer for providing a space between said track and a surface to which said track is mounted, said top being mounted adjacent said surface, said at least one spacer having a curved edge with varying radii of curvature, said at least one spacer being engaged between said top and said surface for rotation in a plane parallel to said top until portions of said edge are substantially simultaneously flush with both said first side and said second side of said track.

15. The track lighting system of claim 13 wherein said at least one universal track clamp further comprises a clamp fastener for providing said adjustable interconnection between said first bracket and said second bracket.

16. The track lighting system of claim 13 wherein said at least one universal track clamp further comprises a third bracket, said third bracket being interconnected with said first bracket, said second bracket, and said at least one lighting component.

17. The track lighting system of claim 16 wherein:

said first bracket has a first main web, a first upper flange extending substantially perpendicularly from said first main web, and a first lower flange extending substantially perpendicularly from said first main web, said first lower flange having an outward extending portion;

said second bracket has a second main web, a second upper flange extending substantially perpendicularly from said second main web, and a second lower flange extending substantially perpendicularly from said second main web; and said third bracket has a support member and a base member substantially perpendicular to said support member, said base member having at least one thickened portion; wherein:

said base member and said second lower flange are adjacent and substantially parallel; and said at least one thickened portion and said second lower flange create an opening in alignment with said extending portion for receiving said extending portion therein.

18. The track lighting system of claim 17 wherein:

said at least one component fastener has a shaft;

said base member has at least one pair of base holes therein, said base holes in each said at least one pair of base holes being spaced apart by a first distance along said length; and said second lower flange has a pair of second flange holes therein, said second flange holes being spaced apart by said first distance along said length; wherein:

said pair of second flange holes is in alignment with one of said at least one pair of base holes, said aligned holes receiving said shaft of said at least one component fastener for fastening said at least one lighting component to said at least one clamp and for providing coarse adjustment of said adjustable interconnection of said first bracket and said second bracket.

19. The track lighting system of claim 18 wherein said at least one universal track clamp further comprises a clamp fastener adjustably interconnecting said first main web and said support member.

* * * * *